US009902599B1

(12) United States Patent
Veresko et al.

(10) Patent No.: US 9,902,599 B1
(45) Date of Patent: Feb. 27, 2018

(54) ADAPTERS FOR VEHICLE LIFTS AND METHODS FOR USING

(71) Applicant: MOHAWK RESOURCES LTD., Amsterdam, NY (US)

(72) Inventors: Ronald W. Veresko, Ballston Spa, NY (US); Christopher H. Strom, East Greenbush, NY (US); Steven Perlstein, Niskayuna, NY (US)

(73) Assignee: MOHAWK RESOURCES LTD., Amsterdam, NY (US)

( * ) Notice: Subject to any disclaimer, the term of this patent is extended or adjusted under 35 U.S.C. 154(b) by 0 days.

(21) Appl. No.: 15/249,126

(22) Filed: Aug. 26, 2016

(51) Int. Cl.
*B66F 7/28* (2006.01)

(52) U.S. Cl.
CPC ..... *B66F 7/28* (2013.01)

(58) Field of Classification Search
CPC ..... B66F 7/00; B66F 7/02; B66F 7/04; B66F 7/28
USPC ..... 187/216, 217, 219, 221
See application file for complete search history.

(56) References Cited

U.S. PATENT DOCUMENTS 3,779,517 A * 12/1973 Fisher ..... B66F 7/04 254/134
4,084,790 A * 4/1978 Molnar ..... B66F 7/02 187/215
4,984,657 A * 1/1991 Burns ..... B66F 7/025 187/207
5,211,264 A * 5/1993 Beattie ..... B66F 7/04 187/208
5,915,500 A * 6/1999 Weaver ..... B66F 7/04 187/216
6,814,342 B1 * 11/2004 Perlstein ..... B66F 7/02 254/1
6,845,848 B1 * 1/2005 Kritzer ..... B66F 7/04 187/213
7,461,733 B2 * 12/2008 Dohi ..... B62D 65/18 198/345.1
2008/0250984 A1 * 10/2008 Panzarella ..... A61G 3/0209 108/44
2009/0183952 A1 * 7/2009 Alford ..... B66F 7/28 187/203
2012/0325587 A1 * 12/2012 Matthews ..... B66F 7/28 187/216
2015/0251884 A1 * 9/2015 Kelly ..... B66F 7/10 184/1.5

OTHER PUBLICATIONS

Mohawk Resources Ltd., Mohawk Model TL-7 Turf Lift Manual, Dec. 18, 2013, 74 pages, available at www.mohawklifts.com
Mohawk Resources Ltd., Mohawk Model TL-7 Turf Lift Brochure, Aug. 2014, 2 pages, available at www.mohawklifts.com

* cited by examiner

*Primary Examiner* — Minh Truong
(74) *Attorney, Agent, or Firm* — Heslin Rothenberg Farley & Mesiti P.C.; Jacquelyn A. Graff

(57) ABSTRACT

Ground care maintenance systems, lift adapters for turning standard vehicle lifts into ground care maintenance or turf lifts, and methods for converting vehicle lifts to ground care maintenance or turf lifts are disclosed. The ground care maintenance system includes a two post pivoting arm lift and a lift adapter configured to couple to the two post pivoting arm lift. The lift adapter including four arm covers and two adapter members each coupled to two arm covers. The method for converting a vehicle lift to a ground care maintenance or turf lift and the turf lift back to the vehicle lift are also disclosed.

13 Claims, 11 Drawing Sheets

ADAPTERS FOR VEHICLE LIFTS AND METHODS FOR USING

FIELD OF THE INVENTION

The present invention relates generally to vehicle lifts. More specifically, but not exclusively, the present invention concerns adapters for turning vehicle lifts into ground care maintenance or turf lifts and methods for converting vehicle lifts to turf lifts and vice versa.

BACKGROUND OF THE INVENTION

Vehicle lifts are often used during vehicle maintenance to access the underside of a vehicle. For cars and trucks, some maintenance needs to be performed from under the vehicle. Thus, it can be more convenient for the maintenance personnel to stand, rather than lay, under the vehicle to perform such maintenance, for example, oil changes. Therefore, by raising the vehicle off the ground maintenance personnel have easier access to perform maintenance from under the vehicle. Short wheelbase vehicles, for example, ground care maintenance vehicles, ride on mowers, utility vehicles, four wheelers, turf equipment, all-terrain vehicles (i.e., four or six wheel vehicles, small farm tractors, etc.), golf carts, scooters, short wheelbase passenger cars (i.e., smart cars) and the like with short wheelbases also require maintenance which may be easier to perform if the vehicles are lifted off the ground. However, standard vehicle lifts are too large to receive and lift vehicles with shorter wheelbases, therefore, in order to avoid needing two different lifts for standard vehicles and vehicles with shorter wheelbases, an apparatus and method for converting a standard vehicle lift to a vehicle lift that can lift vehicles with shorter wheelbases is needed.

SUMMARY OF THE INVENTION

Aspects of the present invention provide lift adapters and ground care maintenance systems for turning vehicle lifts into turf maintenance lifts and methods for converting vehicle lifts to turf lifts.

In one aspect, provided herein is a lift adapter, including four arm covers and two adapter members, each adapter member coupled to two arm covers.

In another aspect, provided herein is a ground care maintenance system, including a pivoting arm lift and a lift adapter. The pivoting arm lift including a first post, a second post spaced apart from the first post, a first set of two pivot arms rotatably coupled to the first post, and a second set of two pivot arms rotatably coupled to the second post. The lift adapter including four arm covers, wherein an arm cover is positioned over each of the pivot arms and two adapter members, each adapter member coupled to two arm covers.

In a further aspect, provided herein is a method of converting a vehicle lift with two spaced apart posts and each post having two pivoting arms to a turf lift, including obtaining a lift adapter. The lift adapter including four arm covers and two adapter members. The method also includes securing one arm cover to each pivoting arm of the vehicle lift. In addition, the method includes aligning a first adapter member on a first set of two arm covers and securing the first adapter member to each of the two arm covers. The method may further include aligning a second adapter member on a second set of two arm covers and securing the second adapter member to each of the two arm covers.

These, and other objects, features and advantages of this invention will become apparent from the following detailed description of the various aspects of the invention taken in conjunction with the accompanying drawings.

BRIEF DESCRIPTION OF DRAWINGS

The accompanying drawings, which are incorporated in and constitute a part of the specification, illustrate embodiments of the invention and together with the detailed description herein, serve to explain the principles of the invention. The drawings are only for purposes of illustrating preferred embodiments and are not to be construed as limiting the invention. It is emphasized that, in accordance with the standard practice in the industry, various features are not drawn to scale. In fact, the dimensions of the various features may be arbitrarily increased or reduced for clarity of discussion. The foregoing and other objects, features and advantages of the invention are apparent from the following detailed description taken in conjunction with the accompanying drawings in which.

DETAILED DESCRIPTION FOR CARRYING OUT THE INVENTION

Generally stated, disclosed herein are embodiments of adapter lifts and adapter systems for turning vehicle lifts into ground care maintenance or turf lifts. Further, a methods for converting a vehicle lift to turf lift and vice versa are discussed.

Figure 1:
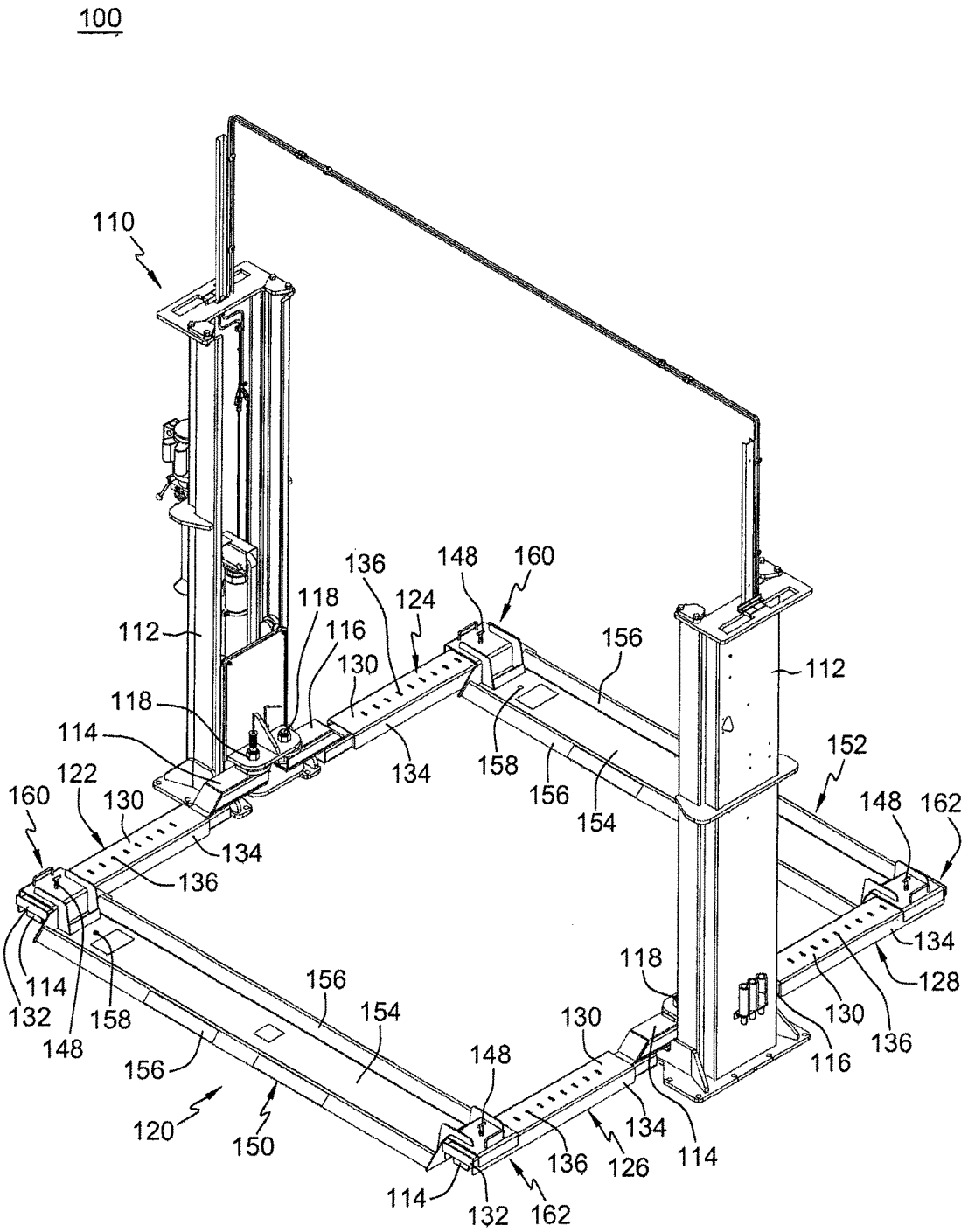
FIG. 1 is a perspective view of one embodiment of a ground care maintenance lift system, in accordance with an aspect of the present invention.
Figure 2:
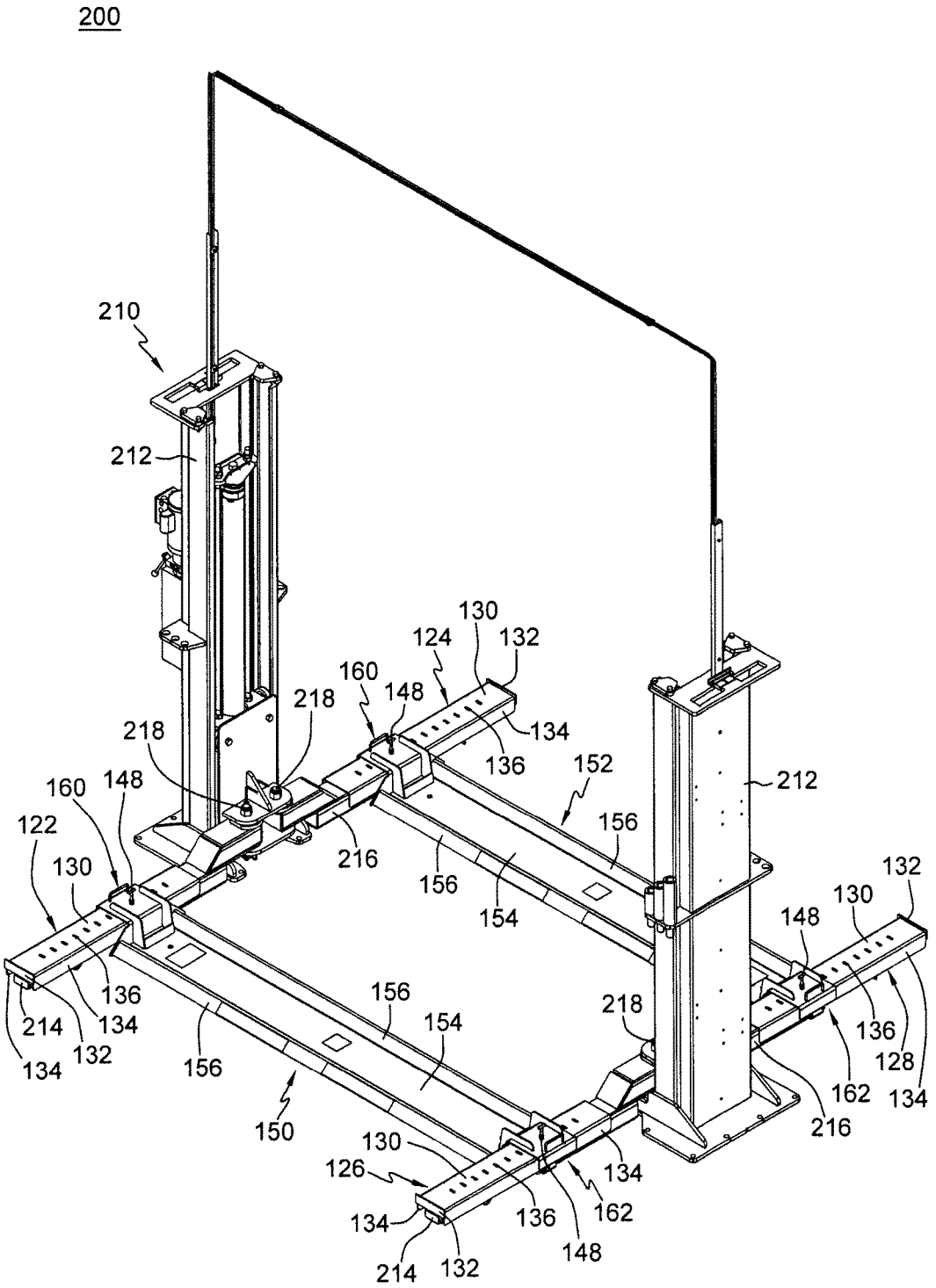
FIG. 2 is a perspective view of another embodiment of a ground care maintenance lift system, in accordance with an aspect of the present invention.
Figure 3:
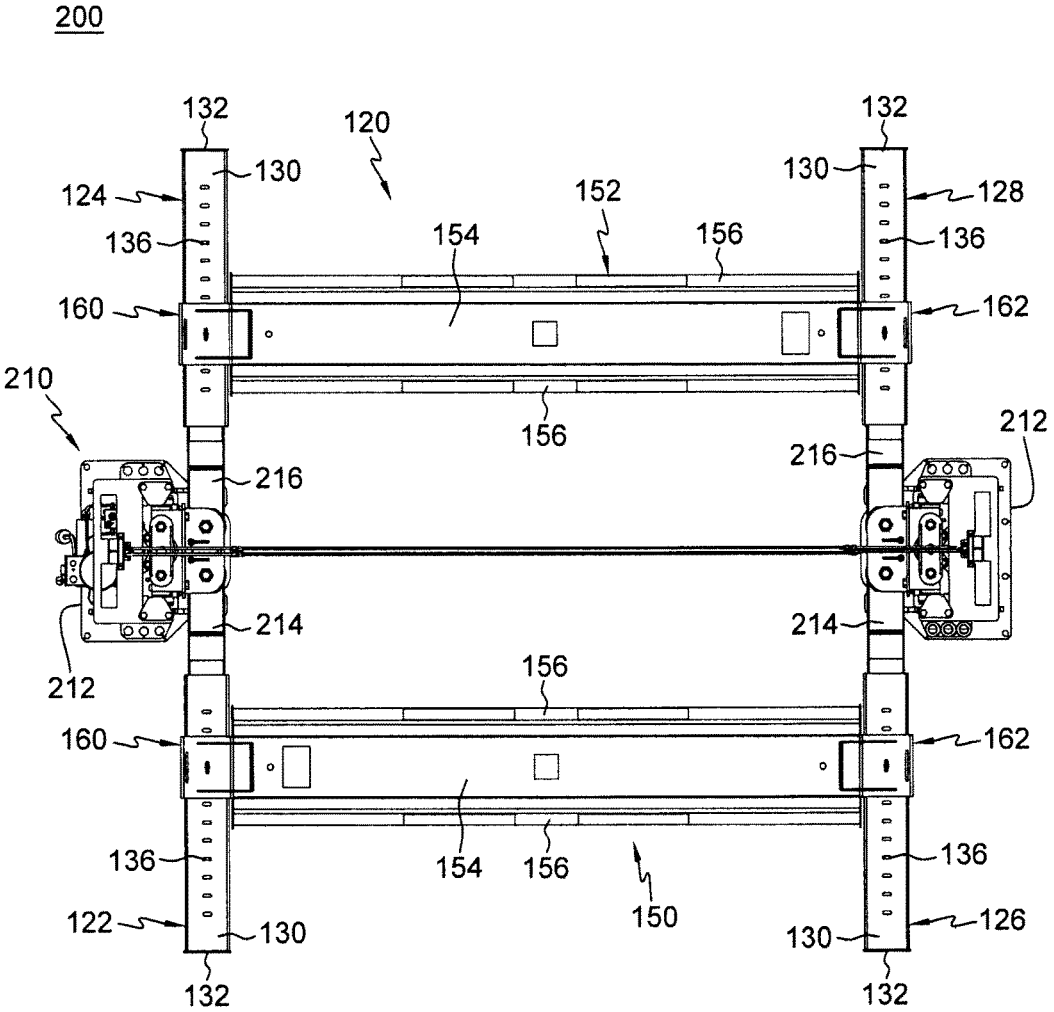
FIG. 3 is a top view of the ground care maintenance lift of FIG. 2, in accordance with an aspect of the present invention.
Figure 4:
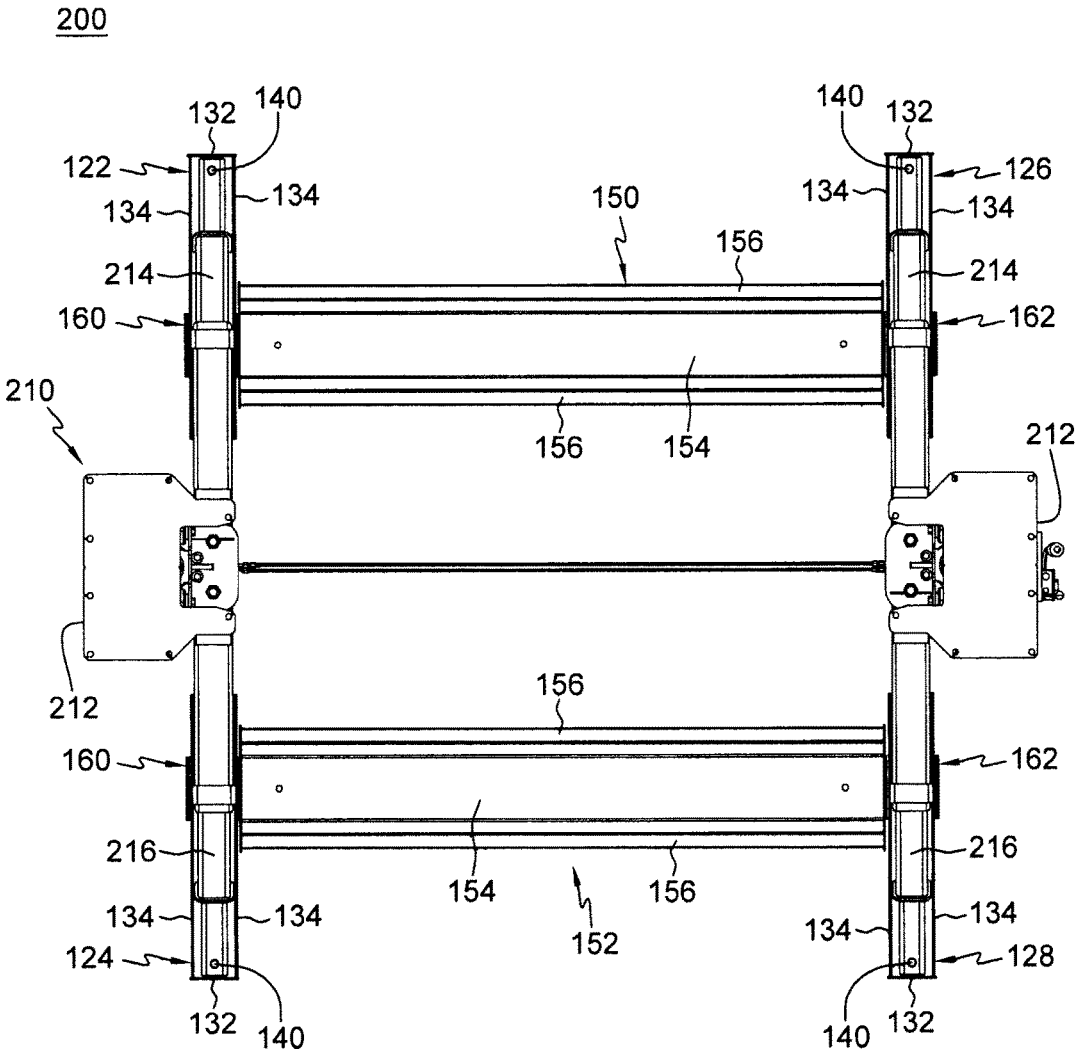
FIG. 4 is a bottom view of the ground care maintenance lift of FIG. 2, in accordance with an aspect of the present invention.
Figure 5:
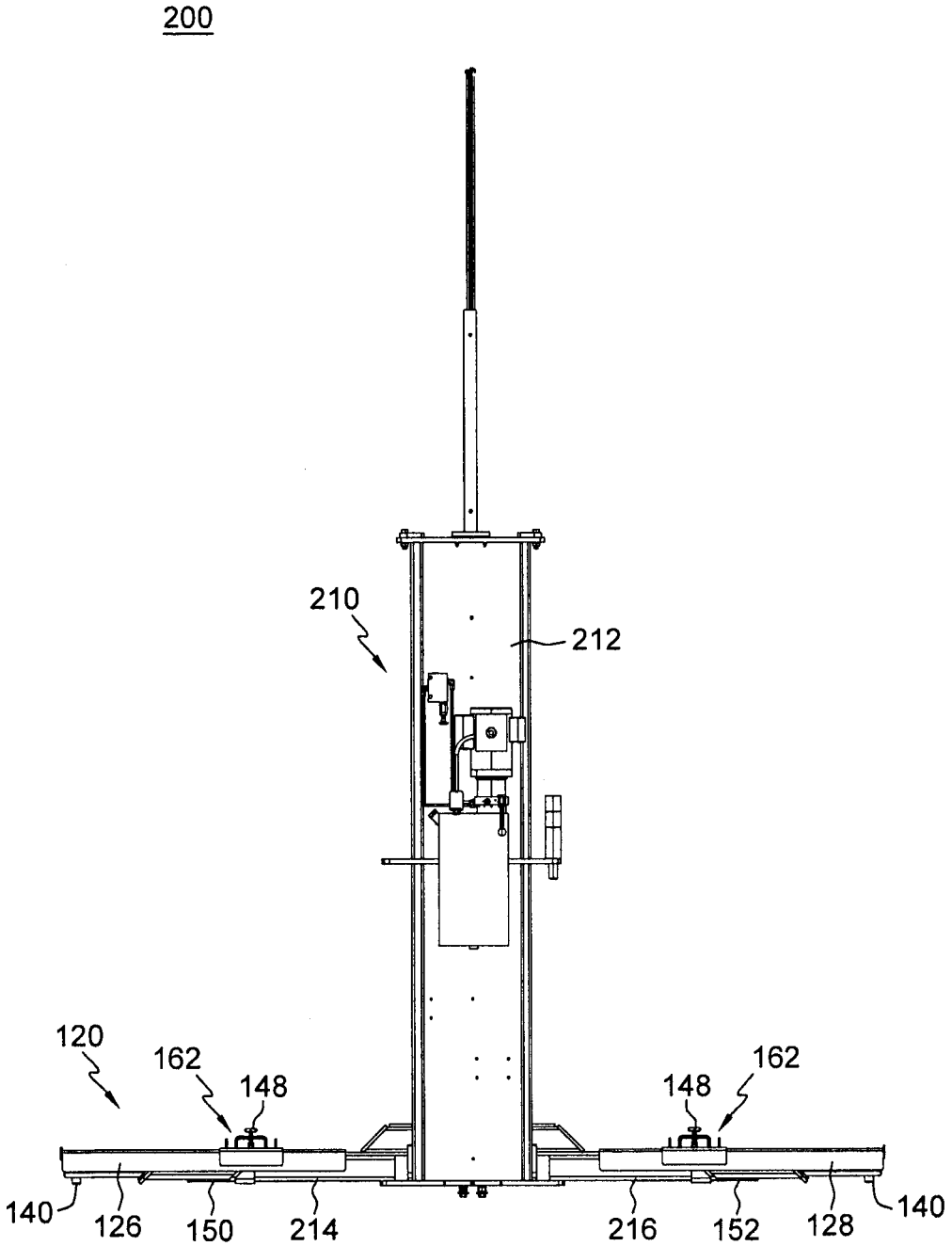
FIG. 5 is a side view of the ground care maintenance lift of FIG. 2, in accordance with an aspect of the present invention.
Figure 6:
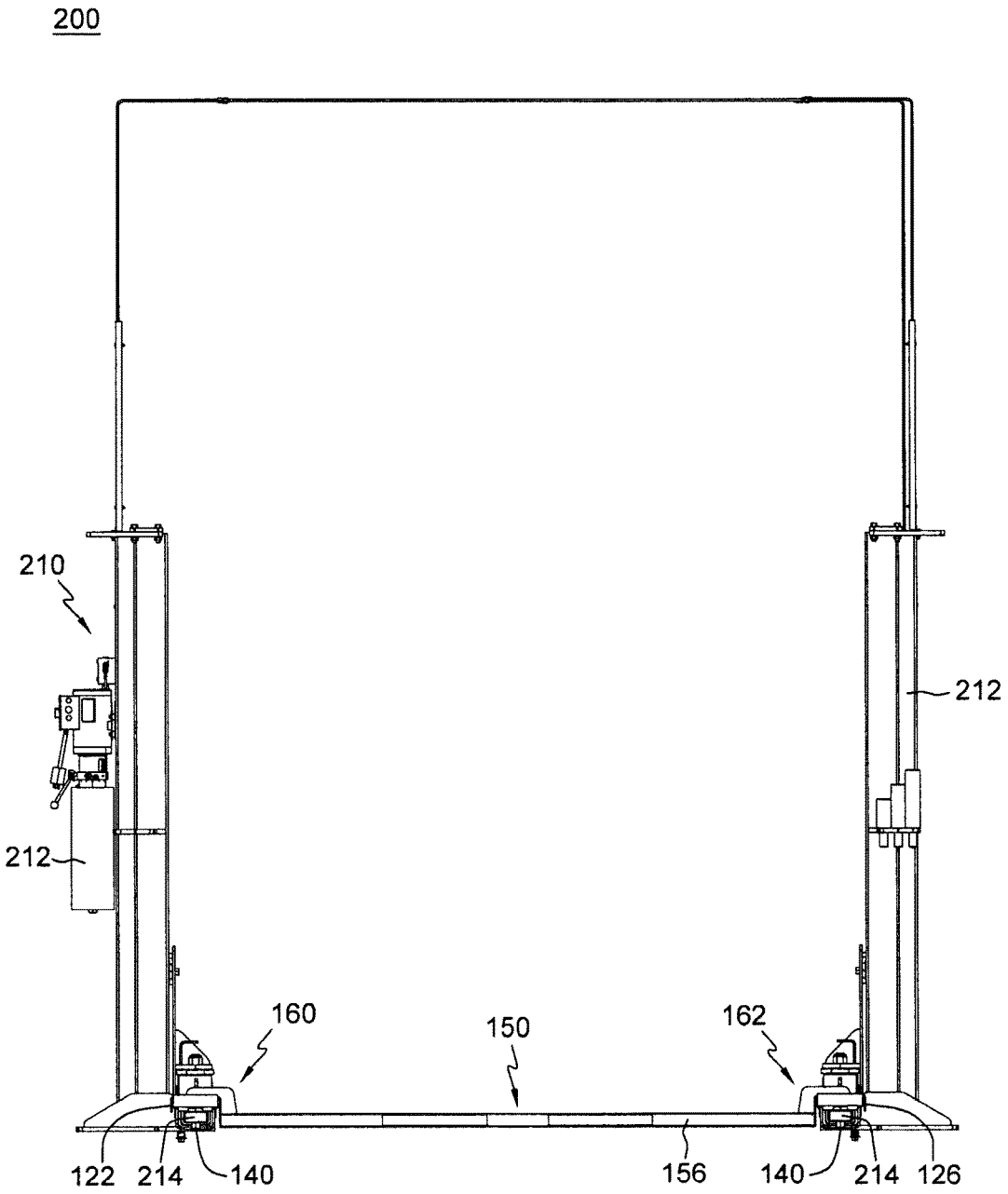
FIG. 6 is an end view of the ground care maintenance lift of FIG. 2, in accordance with an aspect of the present invention.
Figure 7:
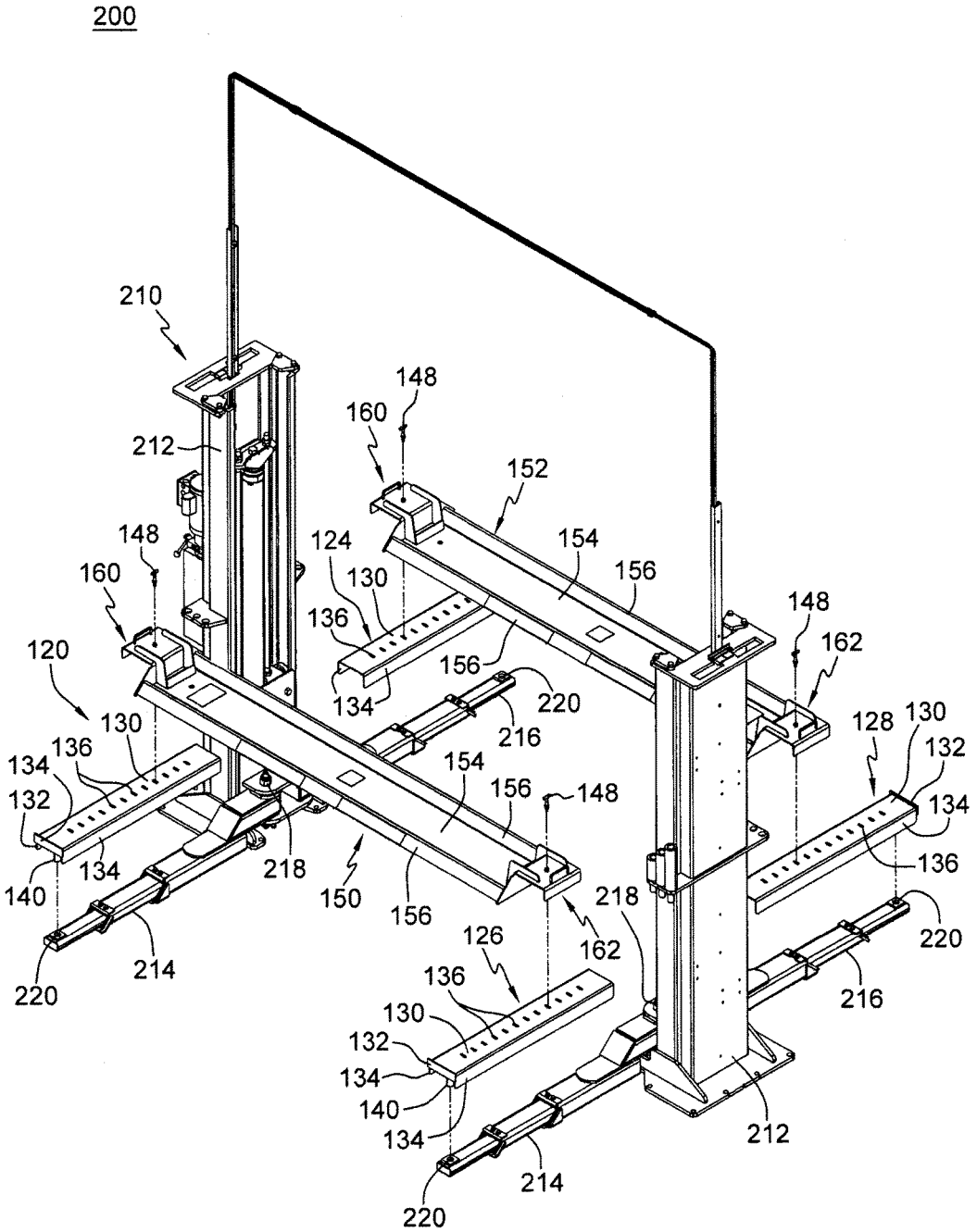
FIG. 7 is a partially exploded, top perspective view of the ground care maintenance lift of FIG. 2, in accordance with an aspect of the present invention.

Referring to the drawings, wherein like reference numerals are used to indicate like or analogous components throughout the several views, and with particular reference to FIG. 1, there is illustrated an exemplary embodiment of a ground care maintenance lift 100. The terms ground care maintenance lift, turf lift, short wheelbase lift, and lift may be used interchangeably herein as they each refer to the same apparatus for raising a short wheelbase vehicle off the ground. The ground care maintenance lift 100 may be used to lift short wheelbase vehicles, for example, ride on mowers, utility vehicles, four wheelers, turf equipment, all-terrain vehicles (i.e., four or six wheel vehicles, small farm tractors, etc.), golf carts, scooters, short wheelbase passenger cars (i.e., smart cars) and the like with shorter wheelbases than standard cars and trucks. The ground care maintenance lift 100 includes a two post pivoting arm lift 110 and a ground care maintenance adapter system or lift adapter system 120. The lift adapter system 120 is used to covert a standard two post pivoting arm lift 110 to a ground care maintenance or turf lift to avoid the need for two separate lifts. The lift adapter system 120 will be described in greater detail below with reference to FIGS. 1-10. The two post pivoting arm lift 110 may include, for example, two spaced-apart posts 112 with each post 112 having a first pivoting arm 114 and a second pivoting arm 116. The pivoting arms 114, 116 may be, for example, telescoping arms which allow for length adjustment. The pivoting arms 114, 116 also rotate about the bolts 118 to allow for positioning of the pivot arms 114, 116 with respect to each post 112.

Referring to the drawings, wherein like reference numerals are used to indicate like or analogous components throughout the several views, and with particular reference to FIGS. 2-8, there is illustrated another exemplary embodiment of a ground care maintenance lift 200. The ground care maintenance lift 200 may be used to lift short wheelbase vehicles, for example, ride on mowers, utility vehicles, four wheelers, turf equipment, all-terrain vehicles (i.e., four or six wheel vehicles, small farm tractors, etc.), golf carts, scooters, short wheelbase passenger cars (i.e., smart cars) and the like with shorter wheelbases than cars and trucks. The ground care maintenance lift 200 includes a two post pivoting arm lift 210 and the lift adapter system 120. The two post pivoting arm lift 210 may include, for example, two spaced-apart posts 212 with each post 212 having a first pivoting arm 214 and a second pivoting arm 216. The pivoting arms 214, 216 may be, for example, telescoping arms which allow for length adjustment. The pivoting arms 214, 216 also rotate about the bolts 218 to allow for positioning of the pivot arms 214, 216 with respect to each post 212. Each pivot arm 214, 216 may also include an opening 220 positioned on each arm 214, 216 opposite the point of attachment with each post 212. The lift adapter system 120 is used to covert the standard two post pivoting arm lift 210 to a ground care maintenance or turf lift in order to avoid the need for two separate lifts.

As seen in FIGS. 1-8, the ground care maintenance adapter system 120 may include, for example, four arm covers 122, 124, 126, 128 and two adapter members or trays 150, 152. The four arm covers may be a first arm cover 122, a second arm cover 124, a third arm cover 126 and a fourth arm cover 128. The two adapter members 150, 152 may be a first adapter member or tray 150 and a second adapter member or tray 152. As shown in FIGS. 1-4, the first adapter member 150 may extend between the first arm cover 122 and the third arm cover 126, while the second adapter member 125 may extend between the second arm cover 124 and the fourth arm cover 128. The adapter members 150, 152 positioned between the arm covers 122, 124, 126, 128 enable the two post pivoting arm lifts 110, 210 to be converted from a standard vehicle lift to a short wheelbase vehicle lift. The lift adapter system 120 may also include securement mechanisms or pins 148 to secure the adapter members 150, 152 to the arm covers 122, 124, 126, 128. The securement mechanisms 148 may be, for example, spring loaded fasteners, threaded T-bolts, plunger pins, hitch pins, or the like to lock the adapter members 150, 152 to the arm covers 122, 124, 126, 128.

Figure 8:
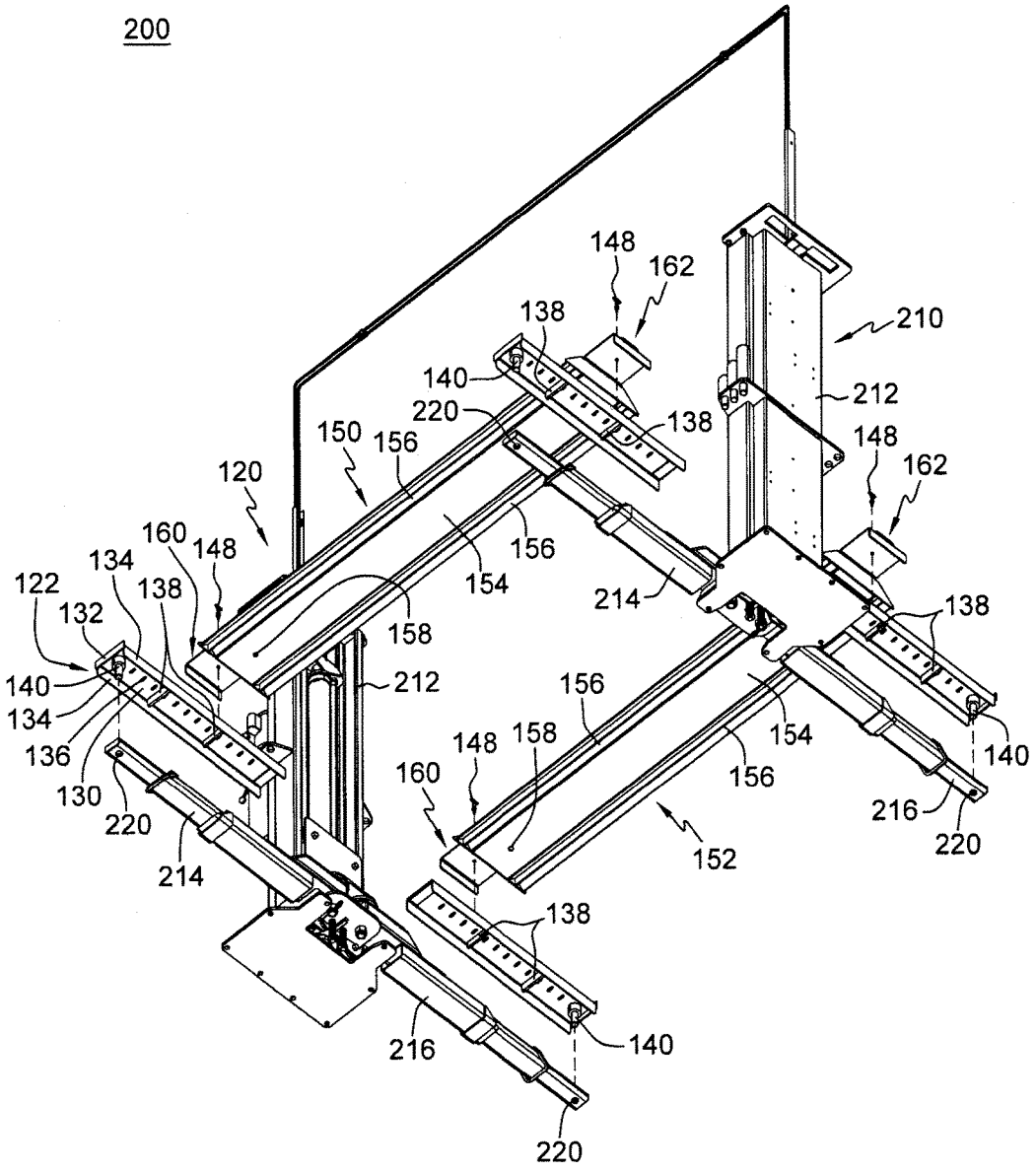
FIG. 8 is a partially exploded, bottom perspective view of the ground care maintenance lift of FIG. 2, in accordance with an aspect of the present invention.
Figure 9:
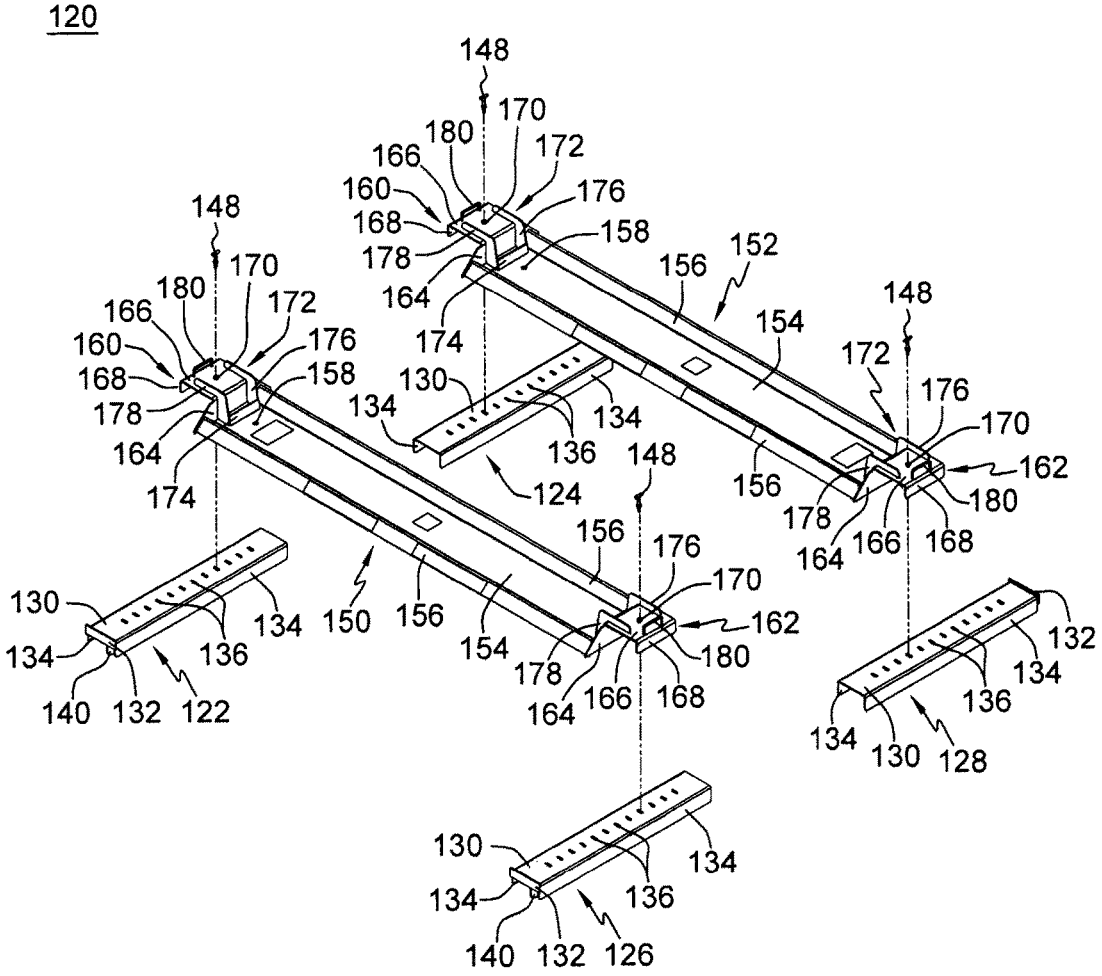
FIG. 9 is an exploded, top perspective view of the ground care adapter system of the ground care maintenance lift of FIGS. 1 and 2, in accordance with an aspect of the present invention.
Figure 10:
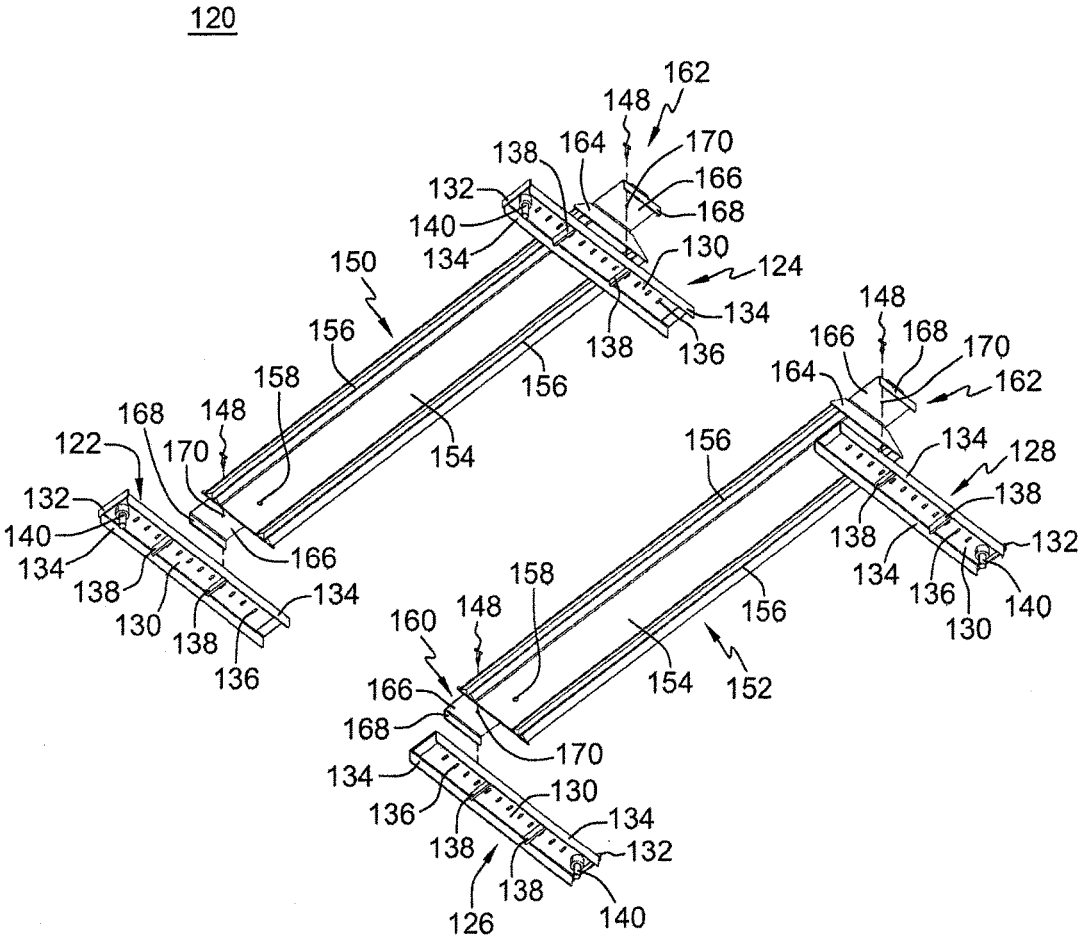
FIG. 10 is an exploded, bottom perspective view of the ground care adapter system of the ground care maintenance lift of FIGS. 1 and 2, in accordance with an aspect of the present invention.

As shown in FIGS. 7-10, each arm cover 122, 124, 126, 128 may include a base 130 with a front flange or wall 132 and sidewalls or side flanges 134. The base 130 may also include a plurality of holes 136 extending from the top surface of the base 130 through to a bottom surface. The front flange 132 may be positioned at one end of the base 130 and extend away from the base 130 in a first direction. The front flange 132 may act as a stopper to prevent the adapter members 150, 152 from sliding off the arm covers 122, 124, 126, 128. The sidewalls 134 may be, for example, positioned on the long sides of the base 130 and extend away from the base 130 in a second direction opposite the first direction. The sidewalls 134 may be configured to have a shape to engage or be positioned adjacent to the sides of the pivot arms 114, 116, 214, 216. The sidewalls 134 may extend, for example, away from the bottom surface of the base 130, while the flange 132 may extend, for example, away from the top surface of the base 130. The arm covers 122, 124, 126, 128 may also each include at least one support member 138 extending between the sidewalls 134 and coupled to the bottom surface of the base 130. In the depicted embodiments, as shown in FIGS. 8 and 10, there are two support members 138. The support members 138 may be, for example, shaped and sized to engage the pivot arms 114, 116, 214, 216 of the two post pivoting arm lift 110, 210. The support members 138 may also be, for example, sized and shaped to level the arm covers 122, 124, 126, 128 when the pivot arms 114, 116, 214, 216 are telescoping arms. Further the arm covers 122, 124, 126, 128 may each include a post or pillar 140 extending away from the bottom surface of the base 130. The post 140 may be positioned on the same end of the arm covers 122, 124, 126, 128 as the front flange 132. The post 140 may be, for example, sized and shaped to be received within the opening not shown, 220 of the two post pivoting arm lift 110, 210.

With continued reference to FIGS. 7-10, each adapter member 150, 152 may include a base 154 with protrusions 156 extending above the base 154 along at least a portion of the length of the base 154. The base 154 may have, for example, a width sized to receive the front and/or rear tires of the vehicle being serviced. The base 154 may have a length, for example, to be positioned between the pivoting arms 114, 116, 214, 216 of the two posts of the pivoting arm lift 110, 210. The protrusions 156 may extend above the base 154 to securely maintain the tires of the vehicle between the protrusions 156 when the vehicle is raised off the ground. The base 154 may also include at least one opening 158 extending from a top surface through to a bottom surface of the base 154 to allow for drainage while maintenance is being performed.

As shown in FIGS. 7-10, each adapter member 150, 152 may also include a first coupling member 160 at a first end and a second coupling member 162 at a second end that is opposite the first end of the base 154. The coupling members 160, 162 may each include a first sidewall 164 coupled to the base 154, a top portion 166 coupled to a top of the first sidewall 164, and a second sidewall 168 extending down from and coupled to the top portion 166 on a side opposite the first sidewall 164. The second sidewall 168 may be, for example, shorter than the first sidewall 164. The top portion 166 may extend away from the first sidewall 164 in a direction opposite the base 154. The top portion 166 may also include an opening 170 for receiving the pins 148 to secure the adapter members 150, 152 to the arm covers 122, 124, 125, 128. The coupling members 160, 162 of each adapter member 150, 152 may also include a support member 172. The support member 172 may include a base member 174, a first arm 176 and a second arm 178. The base member 174 may be positioned on the base 154 of the adapter members 150, 152. The first and second arms 176, 178 may extend from the base member 174 to the top of the first sidewall 164 and across at least part or portion of the top portion 166. The coupling members 160, 162 may each also include a handle 180. The handle 180 may be positioned on and extending away from the top portion 166. The handles 180 may be used for moving the adapter members 150, 152 to convert the two post pivoting arm lift 110, 210 to the turf lift 100, 200 and also for positioning the adapter members 150, 152 along the length of each arm cover 122, 124, 126, 128 for different vehicles between uses.

Figure 11:
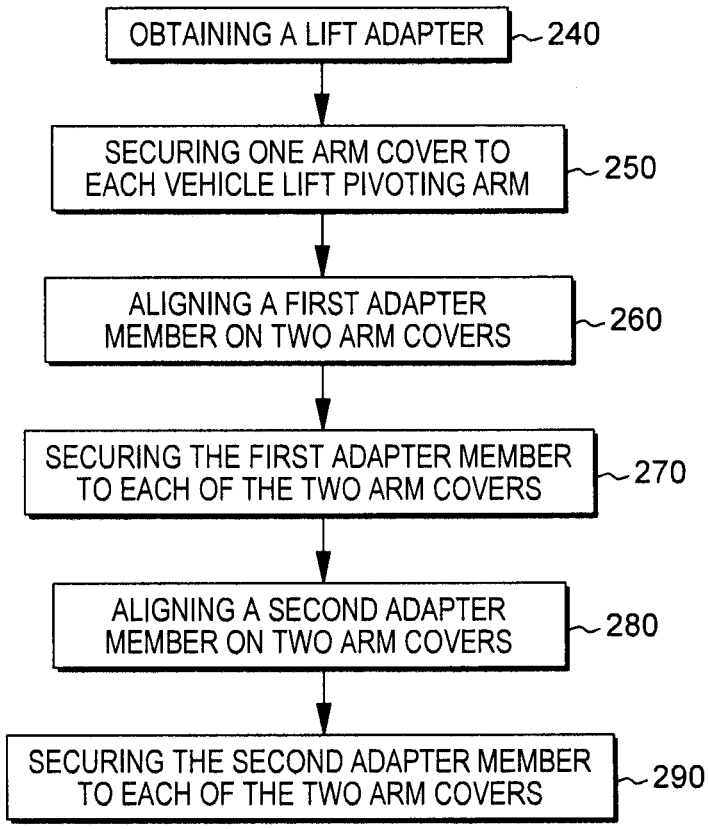
FIG. 11 depicts one embodiment of a method for converting vehicle lifts to turf lifts, in accordance with an aspect of the present invention.

A method for converting standard vehicle lift to a turf lift and the turf lift back to a standard vehicle lift is shown in FIG. 11. The vehicle lifts including two spaced apart posts and each post having two pivoting arms to turf lifts. As shown in FIG. 11, the method may include obtaining a lift adapter 240. The lift adapter 120 may be of the type described above with reference to FIGS. 1-10. The method may also include securing one arm cover to each pivoting arm of the vehicle lift 250. The method may further include aligning a first adapter member on a first set of two arm covers 260 and securing the first adapter member to each of the two arm covers 270. The method may include aligning a second adapter member on a second set of two arm covers 280 and securing the second adapter member to each of the two arm covers 290. The method may further include removing the first and second adapter member and removing the four arm covers to return to a standard vehicle lift.

Referring now to FIGS. 2-10 and with continued reference to FIG. 11, the method may include obtaining the four arm covers 122, 124, 126, 128, two adapter members 150, 152, and four securement members 148 to covert a standard vehicle lift to a turf lift. Next, the first arm cover 122 may be positioned on the first pivot arm 214 of a first post 212, the second arm cover 124 may be positioned on the second pivot arm 216 of the first post 212, the third arm cover 126 may be positioned on the first pivot arm 214 of the second post 212, and the fourth arm cover 128 may be positioned on the second pivot arm 216 of the second post 212. The post 140 of each arm cover 122, 124, 126, 128 may be aligned and inserted into the opening 220 of each pivot arm 214, 216.

After the arm covers 122, 124, 126, 128 are positioned on the pivot arms 214, 216, the adapter members 150, 152 may be positioned on the arm covers 122, 124, 126, 128, as shown in FIGS. 1-6. The first adapter member 150 may be positioned to engage the first coupling member 160 with the first arm cover 122 and the second coupling member 162 with the third arm cover 126. The base 154 of the first adapter member 150 may be positioned between the two posts 212. The second adapter member 152 may be positioned to engage the first coupling member 160 with the second arm cover 124 and the second coupling member 162 with the fourth arm cover 128. The base 154 of the second adapter member 152 may be positioned between the two posts 212. It is also contemplated that the first adapter member 150 may be positioned to engage the first coupling member 160 with the third arm cover 126 and the second coupling member 162 with the first arm cover 122 and the second adapter member 152 may be positioned to engage the first coupling member 160 with the fourth arm cover 128 and the second coupling member 162 with the second arm cover 124. It is further contemplated that the first adapter member 150 may be positioned to engage the second and fourth arm covers 124, 128 and the second adapter member 152 may be positioned to engage the first and third arm covers 122, 126.

After the adapter members 150, 152 are positioned on the arm covers 122, 124, 126, 128, the adapter members 150, 152 may be moved along the longitudinal axis of the arm covers 122, 124, 126, 128 until the desired distance between the adapter members 150, 152 is achieved for the vehicle to be lifted. The adapter members 150, 152 may be moved, for example, using the handles 180. Once the adapter members 150, 152 are positioned at their desired separation, they may be secured to the arm covers 122, 124, 126, 128 using the securement mechanisms 148. A securement mechanism 148 may be inserted through each opening 170 in the adapter members 150, 152, then through one of the plurality of holes 136 in each arm cover 122, 124, 126, 128. The distance between the adapter members 150, 152 may be adjusted when a vehicle is not positioned on them. For example, the distance between the adapter members 150, 152 may be adjusted for various size vehicles by removing the securement mechanisms 148 and repositioning the adapter members 150, 152. Once repositioned, the securement mechanisms 148 may be again inserted into the adapter members 150, 152 and the arm covers 122, 124, 126, 128. After the adapter members 150, 152 are secured to the arm covers 122, 124, 126, 128, a short wheelbase vehicle may be driven onto the adapter members 150, 152 and the pivoting arm lift 110, 210 may be used to raise and lower the vehicle for maintenance.

After maintenance has been performed on a short wheelbase vehicle and the vehicle has been removed from the lift adapter system 120, the adapter members 150, 152 may be adjusted to receive another short wheelbase vehicle for maintenance. Alternatively, after use of the lift adapter system 120, the lift adapter system 120 may be removed from the pivoting arm lift 110, 210 and the lift 110, 210 may be used to perform maintenance on a standard vehicle. The lift adapter system 120 may be installed on and removed from the pivot arm lifts 110, 210 as necessary to allow for maintenance of both standard vehicles and short wheelbase vehicles using the same lift 110, 210.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has", and "having"), "include" (and any form of include, such as "includes" and "including"), and "contain" (and any form of contain, such as "contains" and "containing") are open-ended linking verbs. As a result, a method or device that "comprises," "has," "includes," or "contains" one or more steps or elements possesses those one or more steps or elements, but is not limited to possessing only those one or more steps or elements. Likewise, a step of a method or an element of a device that "comprises," "has," "includes," or "contains" one or more features possesses those one or more features, but is not limited to possessing only those one or more features. Furthermore, a device or structure that is configured in a certain way is configured in at least that way, but may also be configured in ways that are not listed.

The invention has been described with reference to the preferred embodiments. It will be understood that the architectural and operational embodiments described herein are exemplary of a plurality of possible arrangements to provide the same general features, characteristics, and general system operation. Modifications and alterations will occur to others upon a reading and understanding of the preceding detailed description. It is intended that the invention be construed as including all such modifications and alterations.

Having thus described the preferred embodiments, the invention is now claimed to be:

1. A lift adapter, comprising:
- four arm covers;
- two adapter members, each adapter member coupled to two arm covers, wherein each of the two adapter members comprise:
  - a base with a first end and a second end, wherein the base comprises:
    - raised edges positioned along a length of the base and extending above the base;
  - a first coupling member at the first end, wherein the first coupling member comprises:
    - a first sidewall coupled to the base;
    - a top portion coupled to a top of the first sidewall;
    - a second sidewall extending down from and coupled to the top portion on a side opposite the first sidewall; and
    - a support member, wherein the support member comprises:
      - a base member positioned on the base of the adapter member;
      - a first arm extending from the base member to the top of the first sidewall and across at least a part of the top portion; and
      - a second arm extending from the base member to the top of the first sidewall and across at least a part of the top portion;
  - a second coupling member at the second end wherein the second coupling member comprises:
    - a first sidewall coupled to the base;
    - a top portion coupled to a top of the first sidewall; and
    - a second sidewall extending down from and coupled to the top portion on a side opposite the first sidewall; and
- four securement mechanisms to secure the two adapter members to the four arm covers;
- wherein the top portion of the first coupling member comprises an opening for receiving a first securement mechanism of the four securement mechanisms and the top portion of the second coupling member comprises an opening for receiving a second securement mechanism of the four securement mechanisms.

2. The lift adapter of claim 1, wherein each of the four arm covers comprise:
- a base;
- a front flange coupled to a first end of the base; and
- sidewalls coupled to long sides of the base.

3. The lift adapter of claim 2, wherein the front flange extends in a first direction from the base and the sidewalls extend in a second direction from the base, the first direction opposite the second direction.

4. The lift adapter of claim 3, wherein the four arm covers further comprise:
- a plurality of holes extending from a top surface of the base through to a bottom surface of the base.

5. The lift adapter of claim 2, wherein the four arm covers further comprise:
- a post extending away from a bottom surface of the base and positioned at the first end of the base.

6. The lift adapter of claim 3, wherein the four arm covers further comprise:
- at least one support member extending between and perpendicular to the sidewalls.

7. The lift adapter of claim 1, wherein the second coupling member further comprises a support member, the support member comprises:
- a base member positioned on the base of the adapter member;
- a first arm extending from the base member to the top of the first sidewall and across at least a part of the top portion; and
- a second arm extending from the base member to the top of the first sidewall and across at least a part of the top portion.

8. The lift adapter of claim 7, wherein the first coupling member further comprises a first handle coupled to the top of the top portion and the second coupling member further comprises a second handle coupled to the top of the top portion.

9. A ground care maintenance system, comprising:
- a pivoting arm lift, comprising:
  - a first post;
  - a second post spaced apart from the first post;
  - a first set of two pivot arms rotatably coupled to the first post at a first end; and
  - a second set of two pivot arms rotatably coupled to the second post at a first end; and
- a lift adapter, comprising:
  - four arm covers, wherein an arm cover of the four arm covers is positioned over each of the pivot arms; and
  - two adapter members, wherein each adapter member is coupled to two arm covers, wherein each of the two adapter members comprise:
    - a base with a first end and a second end, wherein the base comprises:
      - raised edges positioned along a length of the base and extending above the base;
    - a first coupling member at the first end, wherein the first coupling member comprises:
      - a first sidewall coupled to the base;
      - a top portion coupled to a top of the first sidewall;
      - a second sidewall extending down from and coupled to the top portion on a side opposite the first sidewall; and
      - a support member, wherein the support member comprises:
        - a base member positioned on the base of the adapter member;
        - a first arm extending from the base member to the top of the first sidewall and across at least a part of the top portion; and
        - a second arm extending from the base member to the top of the first sidewall and across at least a part of the top portion;
    - a second coupling member at the second end wherein the second coupling member comprises:
      - a first sidewall coupled to the base;
      - a top portion coupled to a top of the first sidewall; and
      - a second sidewall extending down from and coupled to the top portion on a side opposite the first sidewall; and four securement mechanisms to secure the two adapter members to the four arm covers;

wherein the top portion of the first coupling member comprises an opening for receiving a first securement mechanism of the four securement mechanisms and the top portion of the second coupling member comprises an opening for receiving a second securement mechanism of the four securement mechanisms.

10. The system of claim 9, wherein the each of the pivot arms comprises an opening on a second end, the second end opposite the first end; and wherein each of the four arm covers comprises a post extending from a bottom surface of the four arm covers, the post engaging the opening in the pivot arms.

11. The system of claim 10, wherein a first adapter member of the two adapter members engages a first arm cover of the four arm covers on a first end and a second arm cover of the four arm covers on a second end; and wherein a second adapter member of the two adapter members engages a third arm cover of the four arm covers on a first end and a fourth arm cover of the four arm covers on a second end.

12. The system of claim 11, wherein the first securement mechanism of the first adapter member extends through the first adapter member and engages the first arm cover, the second securement mechanism of the first adapter member extends through the first adapter member and engages the second arm cover, the first securement mechanism of the second adapter member extends through the second adapter member and engages the third arm cover, and the second securement mechanism of the second adapter member extends through the second adapter member and engages the fourth arm cover to secure the first and second adapter members to the four arm covers.

13. A method for converting a vehicle lift with two spaced apart posts and each post having two pivoting arms to a turf lift, comprising:

obtaining a lift adapter, the lift adapter comprising:

four arm covers, wherein an arm cover of the four arm covers is positioned over each of the pivoting arms;

two adapter members, wherein each adapter member is coupled to two arm covers, wherein each of the two adapter members comprise:

a base with a first end and a second end, wherein the base comprises:

raised edges positioned along a length of the base and extending above the base;

a first coupling member at the first end wherein the first coupling member comprises:

a first sidewall coupled to the base;

a top portion coupled to a top of the first sidewall;

a second sidewall extending down from and coupled to the top portion on a side opposite the first sidewall; and a support member, wherein the support member comprises:

a base member positioned on the base of the adapter member;

a first arm extending from the base member to the top of the first sidewall and across at least a part of the top portion; and a second arm extending from the base member to the top of the first sidewall and across at least a part of the top portion;

a second coupling member at the second end, wherein the second coupling member comprises:

a first sidewall coupled to the base;

a top portion coupled to a top of the first sidewall; and a second sidewall extending down from and coupled to the top portion on a side opposite the first sidewall; and four securement mechanisms to secure the two adapter members to the four arm covers;

wherein the top portion of the first coupling member comprises an opening for receiving a first securement mechanism of the four securement mechanisms and the top portion of the second coupling member comprises an opening for receiving a second securement mechanism of the four securement mechanisms;

securing one arm cover to each pivoting arm of the vehicle lift;

aligning a first adapter member on a first set of two arm covers;

securing the first adapter member to each of the two arm covers;

aligning a second adapter member on a second set of two arm covers; and securing the second adapter member to each of the two arm covers.

* * * * *